United States Patent [19]

Garcea

[11] 4,086,063

[45] Apr. 25, 1978

[54] VERTICAL-FLOW CATALYTIC MUFFLER

[75] Inventor: Giampaolo Garcea, Milan, Italy

[73] Assignee: Alfa Romeo S.p.A., Milan, Italy

[21] Appl. No.: 285,355

[22] Filed: Aug. 31, 1972

[30] Foreign Application Priority Data

Aug. 31, 1971 Italy ..... 28068 A/71

[51] Int. Cl.[2] ..... B01J 8/02; B01J 35/02; F01N 1/14; F01N 3/15

[52] U.S. Cl. ..... 23/288 F; 23/288 FA; 60/299; 60/288

[58] Field of Search ..... 23/288 F, 288 FC, 288 FA; 60/299, 288; 252/477 R

[56] References Cited

U.S. PATENT DOCUMENTS

| | | | |
|---|---|---|---|
| 2,853,367 | 9/1958 | Karol et al. | 23/288 F |
| 3,045,422 | 7/1962 | Houdry | 23/288 F |
| 3,050,375 | 8/1962 | Bloch | 23/288 F |
| 3,149,926 | 9/1964 | Johnson | 23/288 FA UX |
| 3,273,971 | 9/1966 | Baddorf et al. | 60/288 X |
| 3,434,806 | 3/1969 | De Rycke et al. | 23/288 F |
| 3,597,165 | 8/1971 | Keith et al. | 23/288 F |
| 3,695,851 | 10/1972 | Perga | 23/288 F |
| 3,722,189 | 3/1973 | Tourtellotte | 55/DIG. 30 |
| 3,729,936 | 5/1973 | De Palma et al. | 23/288 F X |

FOREIGN PATENT DOCUMENTS

| | | | |
|---|---|---|---|
| 1,052,103 | 2/1964 | United Kingdom | 23/288 F |

*Primary Examiner*—Morris O. Wolk
*Assistant Examiner*—Michael S. Marcus
*Attorney, Agent, or Firm*—Holman & Stern

[57] ABSTRACT

A muffler for internal combustion engines to afford a better approach to the solution of air pollution problems due to unburned fuel fractions. The muffler is of the catalytic type and has a flattened structure, with the flow of the exhaust gases through the catalyst taking place in a substantially downward vertical direction. By such an arrangement the gas pressure drop through the catalyst is reduced and the catalyst efficiency is increased.

5 Claims, 8 Drawing Figures

VERTICAL-FLOW CATALYTIC MUFFLER

BACKGROUND OF THE INVENTION

It is known that air pollution problems each day become more and more serious and, are among them, those which are associated with air pollution by the exhaust gases of motor vehicles.

It is known that one of the methods which seems to be very efficient to the end of the solution of these latter problems is the installation of a catalytic muffler in the exhaust duct of an engine, so that the exhaust gases are passed through said muffler before emerging into the outside atmosphere.

The exhaust gases reach the muffler while they contain unburned fractions of several kinds, but they also contain an amount of oxygen which is such as to allow the combustion of these unburned fractions; in the case in which the aforementioned amount of oxygen is not yet contained in the exhaust gases emerging from a cylinder, oxygen is injected into the exhaust stream prior to entering the muffler. Obviously, in a catalytic muffler, the presence of a catalyst is responsible for encouraging the combustion of the unburned fractions by the action of oxygen.

At the same time, a number of problems must be solved when providing a catalytic muffler; among these, the following are considered essential:

(1) Utilization of the catalyst mass so as to have a maximum efficiency without impairing the engine performance.
(2) Maintenance of this efficiency in time.
(3) Technical manufacture of the container in consideration of its service life.
(4) Matching the shape and the size of the muffler with the space requirements in the vehicle.

In connection with the last of the problems enumerated above, the muffler according to the present invention has a flattened shape so that it can be positioned under the vehicle floor without reducing (or reducing to a minimum only) the roominess of the vehicle while maintaining an appropriate distance from the ground. For a vehicle having a front engine, since the temperature decreases along the exhaust pipe towards the outlet end, this approach permits the installation of the muffler at the most appropriate distance from the engine as regards the optimum temperature required for the operation of the catalyst material (see problem No. 1 above).

In order not to impair the efficiency of the engine, (see problem No. 1) it is required, on the other hand, that the pressure drop which the exhaust gas undergoes while flowing through the muffler be small, so that it is imperative both to limit as far as practicable the thickness of the catalyst mass through which the exhaust gases flow and the flow speed: both of these requirements have been fulfilled by providing that the direction of flow through the catalyst mass of the flat muffler (positioned horizontally beneath the vehicle) is vertical.

In further regard to the first of the problems enumerated above, considerations on the physical phenomena which take place in the exhaust gases as they flow through the catalyst mass, have suggested to direct the vertical flow downwards: as a matter of fact in the cold-engine transitional stage, that is, when the exhaust gases are not too hot and on the other hand, also the catalyst mass is cold and draws heat from the gases (a certain temperature should be attained for the catalyst material to become efficient), the gases are so cooled that condensation of the reaction water is experienced. The water, due to the action of the pressure differential upstream and downstream of the catalyst mass, to which the effect of the gravity pull is added in the case of a downward flow, is driven out of the catalyst mass, with a considerable advantage as regards the heating time of the mass inasmuch as, subsequently, when 100° C is locally exceeded, these water droplets are no longer present: these, due to their tendency to evaporate, would draw heat from the exhaust gases thus delaying the catalyst warming up. The vertical flow has then been directed downwards also in connection with the second of the problems above enumerated. In the very frequent case of granular catalysts, the service life could be impaired, in fact, by known friction phenomena, that is the crushing of the granules in their mutual contact areas as a result of the relative motion of any granule with respect to the others. These relative motions can both be induced by the accelerations due to the vibrations to which the muffler is subjected for its being connected to the engine, and by the pulsations of the exhaust gas flow which is passed through the granulated mass.

A comprehensive investigation of the phenomenon has shown that the relative intergranular motions can be prevented only if the pressure differential of the gas as due to its flowing through an individual layer of granules, acts upon any granule in the same direction as the gravity pull and if such a pressure differential exceeds a certain value at which the force applied to a granule exceeds by a certain amount the force acting on the granule due to the vibrations and thus to the cyclically variable accelerations to which the muffler (and thus a granule, supposed integral therewith) is subjected. It has also been ascertained that the attainment of such optimum conditions, with the muffler configuration as suggested herein, can be obtained irrespective of the conditions of use of the engine. On the one hand due to the light weight off the granules and, on the other hand since, at low running speeds of the engine, the gas rates of flow and thus the pressure differentials, are small but also the magnitude of thee vibrations is small, whereas, at a high rate of revolution of the engine, the vibrations are more intense, but also greater are the gas rates of flow and thus also the pressure differentials.

On account of the flattened shape indicated above and thus the reduced thickness of the catalyst layer through which the gas is required to flow, a considerable difficulty, however, is experienced to the end of the first problem, that is, the optimum utilization of the catalyst mass in consideration of the noticeable area of the cross-section which is perpendicular to the flow; the utilization will be at an optimum only if the flow speed of the gas through the layer is equal at all the points of the normal cross-section aforesaid. This can be obtained only if the pressure differential upstream and downstream of the layer is equal for all the points of the cross-section concerned. Space requirements (see problem No. 4) prevent the adoption of the most obvious solution, that is, to provide two considerable volumes, one (having the function of a conveying device) immediately upstream, and the other (acting as manifold) downstream of the layer, with the pressure being constant at any point of the two volumes since the gas flow speed is extremely low.

SUMMARY OF THE INVENTION

In the muffler according to the present invention, this difficulty has been overcome in that in the conveying duct, the feed flow in the several points of the top surface of the catalyst element has a direction which is substantially parallel to said surface, and the flow cross-sectional areas in the conveying duct (perpendicularly to the flowing stream) gradually decrease along the flow path and proportional to the rate of flow which is gradually being left. By so doing, the flow speed of the gas is constant along the several flow tubes and the pressure is thus constant at all the points of the top surface of the catalyst element.

Similarly, the flow of the gases which emerge from the catalyst element takes place in the manifold parallel to the bottom surface of the catalyst; the flow cross-sectional areas gradually increase as the rate of flow is increased along the flow path, so that both the speeds and the pressures are constant also in correspondence with all the points of the bottom surface of the catalyst element. More particularly, in the present muffler, since the catalyst element has a flattened cylindrical shape and whose base are virtually circular, the above mentioned condition as to the constant flow speed for the gases (both upstream and downstream of the catalyst element) is obtained at the inlet by a gas flow having a direction which is virtually radial and centripetal, and at the outlet a direction which is virtually radial and centrifugal, provided that the vertical thickness of the streams aforesaid is maintained constant along the radial flow path. This means that between the top wall of the conveying duct and the top surface of the catalyst the distance is constant at all the points, with the same being true of the distance between the bottom face of the catalyst and the bottom wall of the manifold. With such a configuration, in fact, the cross-sectional areas perpendicular to the flow in the interior of the conveying duct and the manifold are always proportional to the local gas rate of flow: the flow speed is thus constant and so is the pressure.

In one of the embodiments suggested for the structure of the muffler, the idea indicated above (to have the flow cross-section varying so as to maintain it proportional to the local rate of flow of the stream) has been followed also in correspondence with the peripheral annular areas both of the conveying duct and the manifold: this still is in order to keep both the speeds and the pressures constant also at all the points of this environment.

As regards the third problem as indicated above, it is observed that in the present muffler which will be better described with the aid of the drawings, the walls of the catalyst (which are brought to a higher temperature) have the capability of expanding in a manner which is different from that of the outside walls of the muffler; the connection, in ffact, takes place through a single annular wall which is appropriately corrugated so that different expansions are allowed without experiencing internal stresses which would be detrimental to a long muffler service life.

What has been said will be better understood with the aid of FIGS. 1 to 8 of the accompanying drawings, in which there have been shown, by way of nonlimiting examples, a few possible embodiments of the present invention.

BRIEF DESCRIPTION OF THE DRAWING

In the drawings:

FIG. 6*a* is a cross-sectional view of a modification of FIG. 6 in which the annular wall slopes relative to the casing walls

DETAILED DESCRIPTION OF THE EMBODIMENTS

Figure 1:
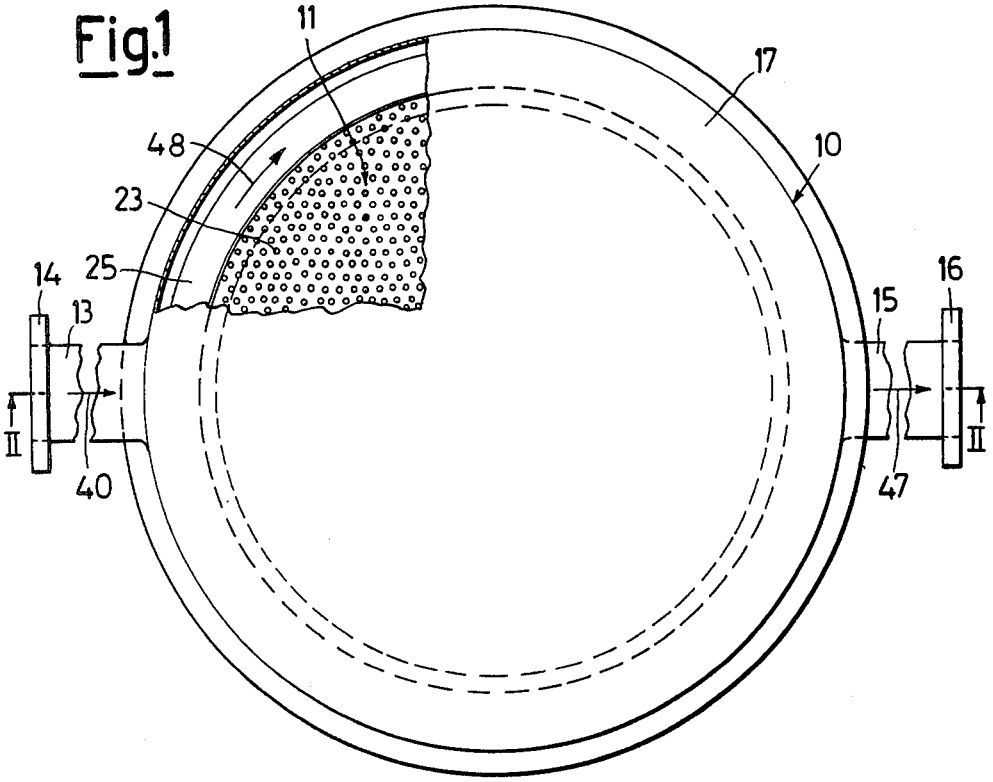
FIG. 1 shows a plan view, partly broken away, of a catalytic muffler made according to the invention.

In FIG. 1, 10 indicates the outer casing having the shape of a flattened cylinder, and 11 the catalyst element, having a top foraminous wall 23 of the container for the granular mass of the catalyst proper.

At 13 there is shown the inlet duct for the exhaust gases into the muffler: to the inlet duct is welded a flange 14 which is connected to a corresponding flange of the exhaust duct coming from the engine (not shown), 15 is the outlet duct of the exhaust gases from the muffler (diametrically opposite to the inlet duct) also provided with a flange 16 for connection to the exhaust pipe which discharges the gases into the atmosphere (not shown).

Figure 2:
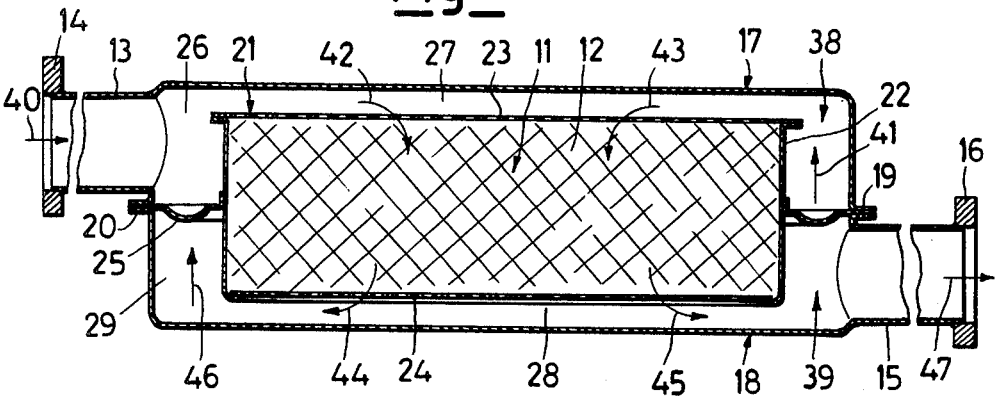
FIG. 2 is an axial cross-sectional view taken along the line II—II of FIG. 1, the views looking in the direction of the arrows.

In FIG. 2, there are indicated at 17 the top half-shell of the casing 10 to which the inlet duct 13 is connected and at 18 the bottom half-shell to which the outlet duct 15 is connected. Both half-shells are provided with curled edges 19 and 20, respectively, by which the two half-shells are united to one another. The granules of the catalyst mass 12 are placed in the interior of container 21, formed by an annular sheet metal band 22, the top circular wall of foraminous sheet metal 23 and a circular bottom wall 24, also of foraminous sheet metal, with the band 22 being welded to the peripheral edges of the walls 23 and 24.

Since the peripheral and the central portions of the circular walls of the two half-shells 17 and 18 and of the walls 23 and 24 of the container 21 for the catalyst are subjected to different thermal stresses, it is advisable, in order to prevent deformations, that the walls be so shaped as to absorb the different expansions of said areas. Preferably, the walls are slightly crowned, having their convex face either upwards or downwards with an appropriate radius of curvature. Of course, the shape to be selected will be the same for all the walls aforesaid so that the thickness of the cylindrical volumes 27 and 28 and the thickness of the catalyst mass 12 will remain constant over the entire circular surface.

At 25 there is indicated an annular wall of sheet metal whose outer edge is welded to the casing at the edges of the two half-shells 17 and 18 and whose inner edge is welded to the band 22 of the container 21. The sheet metal of the annular wall 25 is corrugated so as to prevent the formation of internal stresses and to absorb the different expansions of the container 21 and the muffler casing 10, originated by the different thermal stresses to which these members are subjected.

The exhaust gases entering the muffler through the inlet duct 13, occupy space 38 acting as a conveying duct formed by the annular volume 26, in which the fluid components take a motion having an upwardly directed axial component, and by the flattened cylindrical chamber 27, in which, on account of the reduced thickness, the fluid components are moved with a substantially radial and centripetal motion, and flow through the cylindrical surfaces, which decreases from the periphery towards the center and are coaxial with the peripheral surface of the cylindrical volume 27. The gases, as they converge towards the center of said cylindrical chamber, penetrate through the holes of the circular wall 23 into the catalyst proper and, due to such a continuous gas draw, the rate of flow decreases from the periphery towards the center of the cylindrical volume 27. Inasmuch as the residual flow passes through successive cylindrical surfaces which are reduced proportionally to the reduction of the rate of flow, the speed of the fluid particles is maintained constant along the entire flow path from the periphery to the center for all the fluid components and the gas pressure remains constant and equal at all the points of the wall 23 and thus at the inlet of the catalyst element.

The gases flow through the catalyst mass 12 following a substantially axial flow path and the contact with the granules starts, in the presence of oxygen, the combustion of the unburned particles which are still contained in the exhaust gases. The gases, after flowing through the catalyst mass 12, emerge from the perforated circular wall 24 of manifold 39 as formed by the flattened cylindrical chamber 28 and the annular space 29.

In the chamber 28, on account of the limited thickness, the gases take a radial centrifugal motion and flow through the cylindrical surfaces, which are increased from the center towards the periphery, coaxially with the peripheral surface of the cylindrical chamber 28, whereas the gases are directed towards the periphery of said cylindrical chamber and their rates of flow continue to be increased as the gases which have passed through the catalyst proper emerge from the holes of the circular wall 24.

Inasmuch as this gradually increasing rate of flow passes through gradually increasing sequentially arranged cylindrical surfaces, the flow speed is maintained constant along the entire flow path from the center to the periphery for all of the fluid components, so that the pressure of the gas is constant and equal at all the holes of the wall 24 at the outlet of the catalyst element. The gas then enters the annular space 29 in which they take an upward axial motion and thence they are directed towards the muffler outlet duct 15. The arrows 40, 41, 42, 43, 44, 45, 46, 47 and 48 in FIGS. 1 and 2 indicate the flow path of the gases in the interior of the muffler.

The gas flowing in the interior of the annular space 26, being displaced from the areas close to the inlet duct 13 to those diametrically opposite, undergoes a speed drop with an attendant pressure increase since a fraction of the gas begins to flow through the catalyst at an ever decreasing rate of flow and flows through the constant flow cross sections of the annular space 26.

In the annular space 29, ever increasing rates of flow are passed through the flow cross-sectional areas of the same space and are directed towards the outlet duct 15; since the flow cross-sectional areas are constant, by increasing the rate of flow, the flow speed of the gas is proportionally increased while the pressure is decreased.

Figure 3:
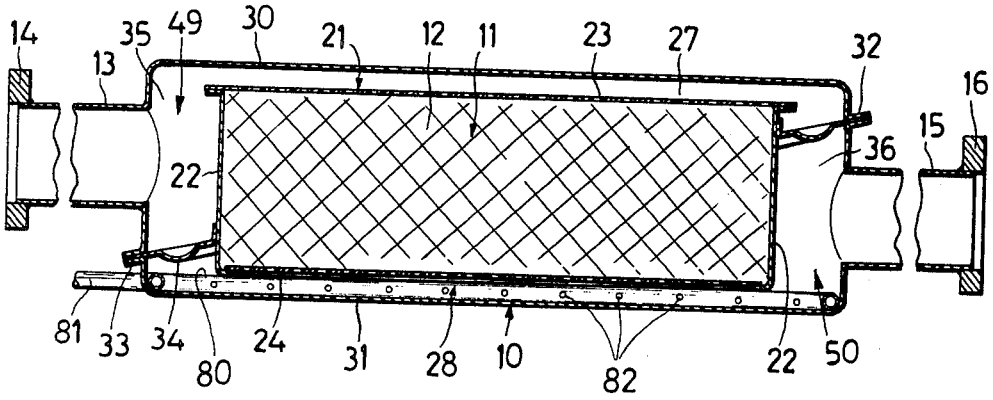
FIG. 3 is a view similar to FIG. 2 of an improved modification of the muffler.

In order to overcome all of these drawbacks and, more particularly, in order to have a constant pressure distribution at the periphery of the cylindrical space 27, the applicants have studied the muffler as shown in FIG. 3, wherein parts equivalent to those of the muffler of FIGS. 1 and 2 have been indicated with the same reference numerals.

There are shown at 30 the top half-shell of the casing 10 to which the duct 13 is connected and at 31 the bottom half-shell to which the duct 15 is connected, with the shells having curled down edges 32 and 33, respectively, in correspondence with which the two half shells are welded together.

At 34 there is shown a substantially annular corrugated sheet metal wall whose outer edge is welded to the casing 10 in correspondence with the edges of the two half-shells 30 and 31 and whose inner border is welded to the band 22 of the casing 21. Since the wall 34 slopes relative to the casing walls, annular space 35 of conveying duct 49 has a variable height, with the maximum height being in correspondence with the gas inlet duct 13 and annular space 36 of manifold 50 has also a variable height, with the maximum height being in correspondence with the gas outlet duct 15.

As a matter of fact, the exhaust gas entering the muffler, while being distributed in the annular space 35 begins to flow through the catalyst element in the manner described in connection with the muffler of FIGS. 1 and 2, and, for a certain rate of flow, the quantity of gas which reaches the areas of the annular space opposite to the inlet duct, is smaller than the one of the areas close to the same duct, since a portion of the rate of flow of the exhaust gas has already begun to flow through the catalyst element. Thus, inasmuch as the rate of flow is decreasing, for the flow speed to be kept constant, along with the pressure at all the points upstream of the catalyst, the flow cross-sections for the gas in the annular space become more and more reduced, the farther one goes from the inlet duct, in a manner which is proportional to the residual exhaust gas rate of flow.

The trend of the flow in the cylindrical spaces 27 and 28, upstream and downstream of the catalyst element, respectively, is similar to that of the muffler described in the preceding Figure. In the annular space 36, the quantity of gas flowing therethrough upon flowing through the catalyst element, is increased as far as the gas proceeds towards the outlet duct 15, with the flow cross-sections for the gas being gradually increased proportionally to the ever growing rates of flow and the speed and the pressure are kept constant everywhere downstream of the catalyst element.

Furthermore, in FIG. 3 is shown how an air injector can be arranged inside the muffler. This is desired, for example, when the exhaust system is followed by an oxidizing-type muffler. Advantageously, the injector is defined by a tube 80 which is peripherally wound around the base 31 and receives compressed air at end 81 to discharge the air into the space 50 through holes 82 distributed therealong. With such a distribution of the outlet nozzles 82 for the air coming from any suitable compressed air source (not shown), an extremely uniform gas mixture emerges from the tube 15 and is thus adapted to receive a subsequent catalyst treatment.

The tube 80 can be applied, in addition to the muffler shown in FIG. 3, to other cylindrical mufflers according to the invention.

Figure 4:
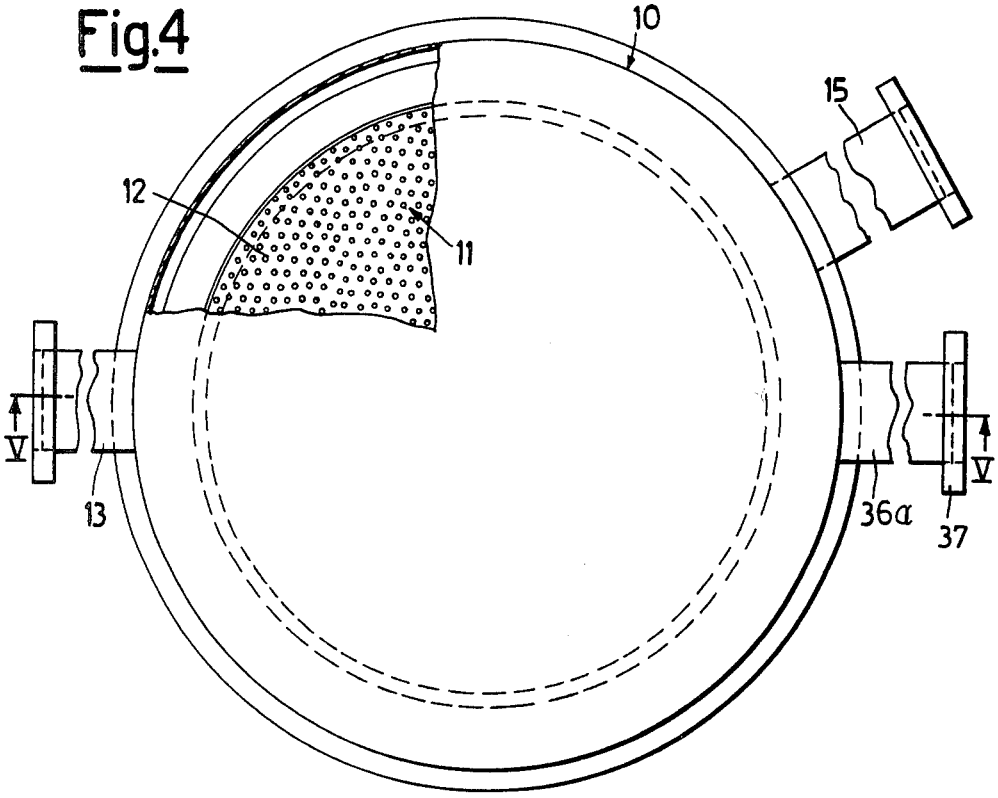
FIG. 4 is a view similar to FIG. 1 of a catalytic muffler made according to the invention, having an internal by-pass duct.
Figure 5:
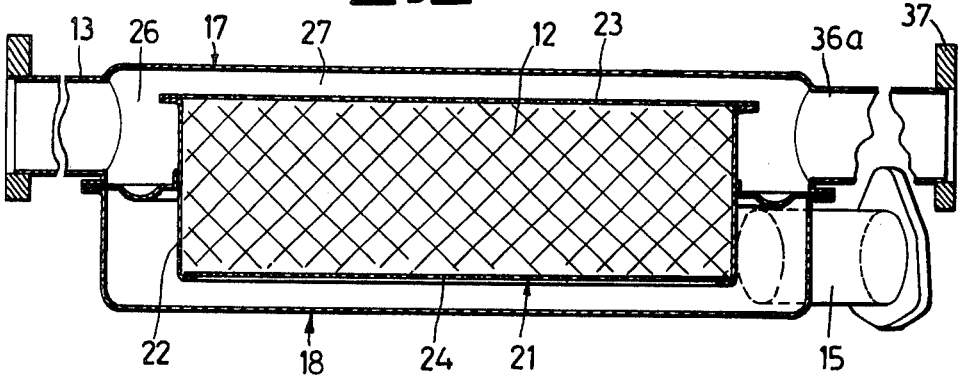
FIG. 5 is an axial cross-sectional view taken along the line V—V of FIG. 4, the view looking in the direction of the arrows.

Equivalent reference numerals of FIGS. 1 and 2 for the same or equivalent parts have been used for the muffler shown in FIGS. 4 and 5.

In addition to the duct 15 for the gas outlet from the muffler, a duct 36*a* has also been provided; this is equipped with a flange 37, which is connected to a corresponding flange of the exhaust pipe which carries the gas outside (not shown).

Both in the outlet tube connected to the duct 36*a* and in the outlet tube connected to the duct 15, there can be mounted a valve upstream of the outlet port of the gases towards the atmosphere, with the valve being controlled, for example, by a device consisting of a rod fastened to a resilient wall of a chamber fed by the negative pressure downstream of the throttle in the inlet duct.

The device, which has not been shown as it is conventional, is intended to keep one open when the other is closed and vice versa, as a function of the negative pressure in the inlet duct, and permits one to throttle either of the outlet pipes, so that, at moderate powers of the engine, since the valve inserted in the outlet tube connected to the duct 15 is open while the valve inserted in the outlet tube connected to the duct 36*a* is closed, the exhaust gases emerge from the duct 15 after having passed through the catalyst element of the muffler. At high powers, since the opposite situation is experienced, the exhaust gases coming from the inlet duct 13 flow through the annular space 26 and the cylindrical space 27 and emerge from the muffler through the duct 36*a* without flowing through the catalyst element, inasmuch as a renewed combustion is not required due to the limited percentage of unburned fractions present in the gases and without subjecting the catalyst material to thermal stresses which would impair its further operability because of the high temperature of the gases. In this regard, attention is invited to applicant's U.S. Pat. No. 3,820,328 dated June 28, 1974 relating to an exhaust system provided with a by-pass duct of the catalytic muffler.

Figure 6:
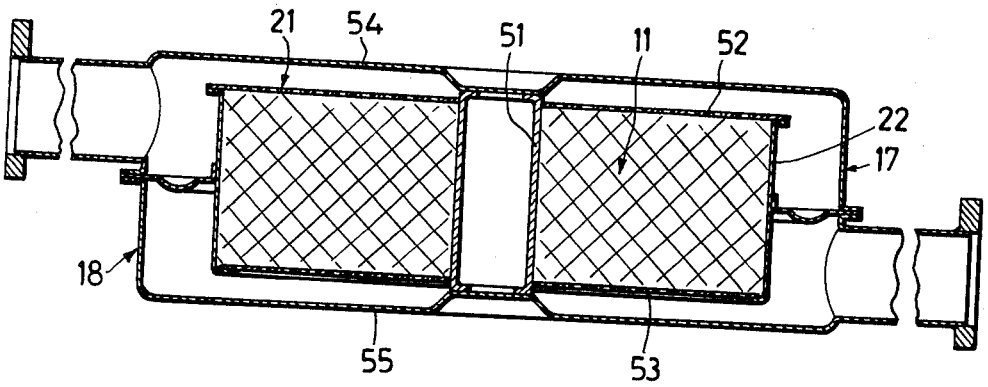
FIG. 6 is an axial cross-sectional view of a modification of the muffler of FIG. 1.

In FIG. 6 there is shown a modified embodiment of the muffler of FIG. 1, constructed in such a way as to reduce the possible occurrence for vibrations of the catalyst element.

The container 21 for the catalyst element 11 consists of a sheet metal cylindrical wall 22, a second sheet metal cylindrical wall 51, coaxial with the first wall and having a lesser diameter and two annular walls, with one being a top wall 52 and the other a bottom wall 53 which are welded in correspondence with their inner edges to the wall 51 and in correspondence with their outer edges to the wall 22. A to wall 54 and a bottom wall 55 of the two half-shells 17 and 18 of the muffler casing are annular and have their inner edges also welded to the wall 51.

Figure 8:
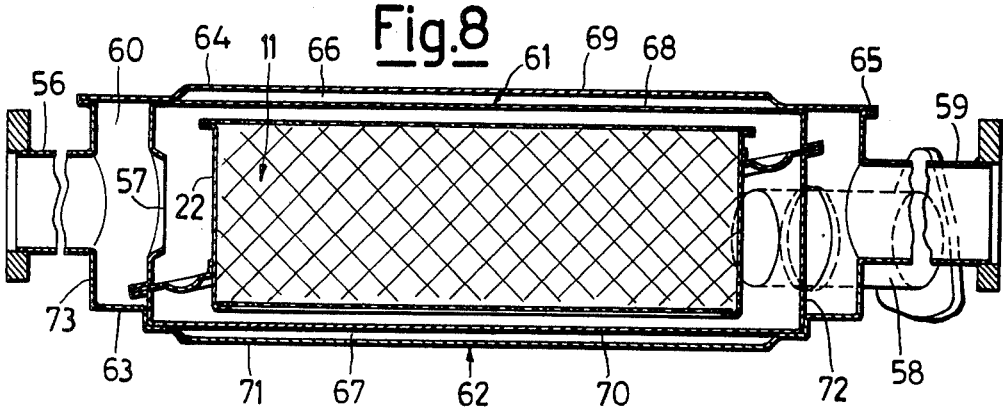
FIG. 8 is a cross-sectional view taken along the line VIII—VIII of FIG. 7, the view looking in the direction of the arrows.
Figure 7:
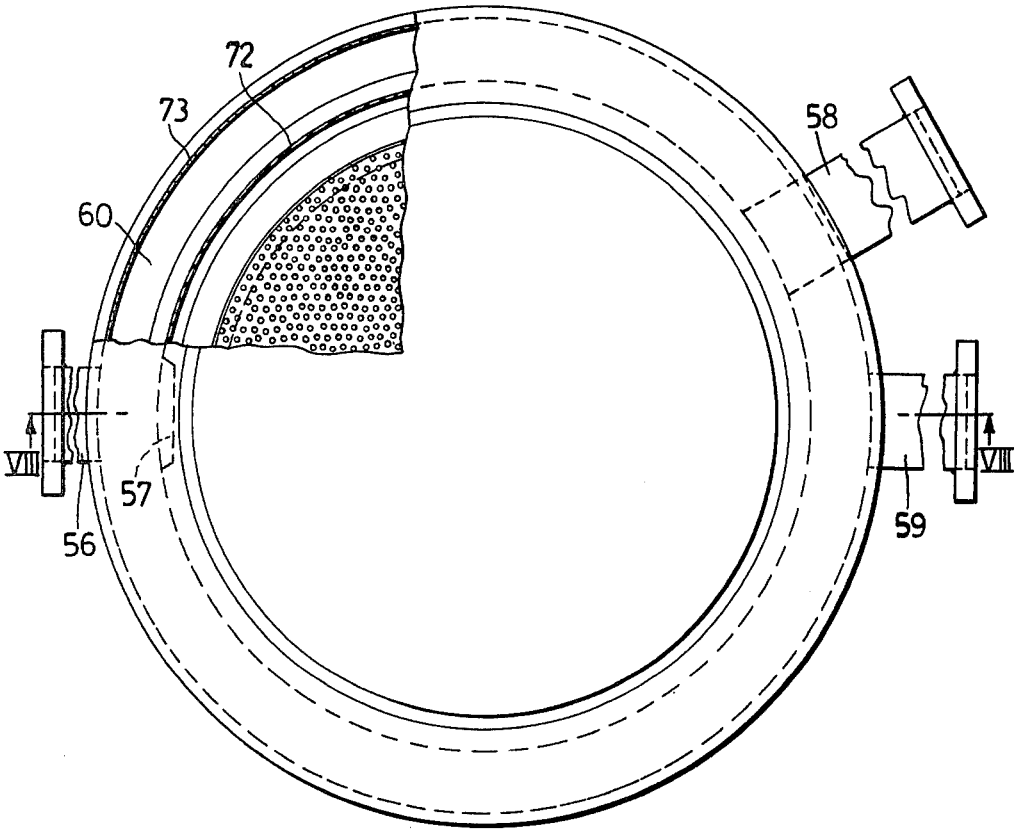
FIG. 7 is a plan view, partly broken away, of a muffler made similarly to that of FIG. 3, but with an internal by-pass duct.

In FIGS. 7 and 8, there are indicated at 56 the inlet duct for the exhaust gases into the muffler, at 57 the flow port for the gases which pass through the catalyst element 11, at 58 the outlet duct of the muffler for the gases which have passed through the catalyst element aforementioned and at 59 the outlet duct of the muffler for the gases which have by-passed the catalyst element. There are indicated at 61 the outer casing of the catalyst element 11 and a 62 the outer casing of muffler, consisting of container 63 and lid 64 welded at 65.

There are indicated at 66 and 67, the flattened cylindrical spaces which are confined by circular top walls 68 and 69 and circular bottom walls 70 and 71, respectively, of the casings 61 and 62, in which the gas remains substantially stationary, thus providing a heat insulation for the muffler.

The gases which by-pass the catalyst element 11 when the exhaust pipe connected to the duct 58 is throttled, pass through the annular space 60, as confined by annular bands 72 and 73 of the casings 61 and 62, emerging from the duct 59.

Such an embodiment has been suggested by the fact that in the muffler shown in FIG. 3 it is not advisable, for by-passing the catalyst element, to insert into the outer casing 10 of the muffler a second outlet duct as in the muffler shown in FIG. 5, because the gases which do not flow through the catalyst element 11 to emerge to the outside, would be moved in the annular space 49 and in the cylindrical volume 27 and in said annular space they would flow through ever decreasing cross-sectional areas and would undergo, at high powers, pressure drops which would originate too high back pressures in the exhaust pipe.

In the examples shown, the mufflers are provided with granular catalyst material but, since the majority of the problems which have led to the approaches suggested herein exist also in a case in which the catalyst material is in bulk or is a foraminous solid element, it is obvious that what has been said herein is quite valid in general.

What we claim is:

1. A catalytic muffler inserted in an exhaust duct of an internal combustion engine of a motor vehicle, including (a) an outer casing in the shape of a substantially flattened cylinder, having reduced height with respect to the diameter and having a substantially vertical axis, said casing being defined by an assembly of one each of upper and lower sheet metal half-shells connected to one another in a sealed tight manner along a line lying on the outer cylindrical surface and on a plane inclined with respect to the vertical axis, each half-shell being defined by only one piece of metal sheet and including an essentially planar wall of circular outline and a cylindrical side wall, of a height gradually decreasing and having a free edge lying on said inclined plane, (b) a first gas inlet duct connected to the cylindrical side wall of the upper half-shell at the zone thereof of greatest height, (c) a second gas discharge duct connected to the cylindrical side wall of the lower half-shell at the zone thereof of greatest height, (d) a catalyst element proper, having also substantially the shape of a flattened cylinder, namely reduced height with respect to the diameter thereof, mounted in the interior of the outer casing and co-axial therewith, a side annular wall of the catalyst element being gas impervious, while upper and lower circular walls of the catalyst element are permeable to the gas, whereby the flow of the gases through the catalyst element takes place predominantly along a direction which is substantially parallel to the vertical axis of the catalyst element, (e) a wall having inner and outer edges, said wall, having an annular shape and of corrugated metal sheet lying on the same inclined plane of the edges of said half-shells, the inner edge of said annular corrugated wall being connected to the side annular wall of the catalyst element, the outer edge of the corrugated annular wall being connected to the edges of said half-shells, (f) a chamber defined by the walls of the upper half-shell, the walls of the catalyst element and the annular corrugated wall, said chamber communicating with said inlet duct and serving as a manifold for conveying the gases towards the upper circular wall of the catalyst element, said chamber including an annular capacity positioned above said annular corrugated wall, said capacity having decreasing height, which is equal in every point to the height of the cylindrical side wall of the upper half-shell and further including a capacity positioned above the catalyst element and having a cylindrical flattened shape namely having a diameter like that of said catalyst element and height much lower than the diameter and (g) a chamber defined by the walls of the lower half-shell, the walls of the catalyst element and the annular corrugated wall, said chamber communicating with the discharge duct and serving as a manifold for the gases coming out of the lower circular wall of the catalyst element, said chamber comprising an annular capacity positioned under the annular corrugated wall, said capacity having increasing height, which in every point is equal to the height of the cylindrical side wall of the lower half-shell, and further including a capacity positioned below the catalyst element and having a cylindrical flattened shape, namely having a diameter equal to that of the catalyst element, but of very reduced height with respect to the diameter.

2. The catalytic muffler according to claim 1, wherein a further gas duct comprising a catalyst by-pass outlet duct is connected to the cylindrical side wall of the upper half shell in spaced relationship to the first gas inlet duct.

3. The catalytic muffler according to claim 1, wherein the ducts are connected to the cylindrical wall of the outer casing at substantially diametrically opposite points.

4. The catalytic muffler according to claim 1, characterized in that in the catalyst element a granular mass is positioned in the interior of a casing formed by a sheet metal cylindrical wall whose edges are connected to the edges of a top foraminous circular wall and a bottom foraminous circular wall which are essentially planar and having a circular outline.

5. The muffler according to claim 1 characterized in that in the interior of the annular space beneath the annular wall there is arranged a foraminous duct of annular shape, one end of which opens at the outside of the casing for connection to a source of compressed air.

* * * * *